US009564256B2

(12) United States Patent
Manke et al.

(10) Patent No.: US 9,564,256 B2
(45) Date of Patent: Feb. 7, 2017

(54) POWER CABLE FOR HIGH TEMPERATURE ENVIRONMENTS

(75) Inventors: Gregory H. Manke, Overland Park, KS (US); Mark Metzger, Lawrence, KS (US); Melissa Ver Meer, Shawnee, KS (US); Tricia Lespreance, Topeka, KS (US); Wayne Costa, Lawrence, KS (US); Jason Hozmueller, Lawrence, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 496 days.

(21) Appl. No.: 13/330,439

(22) Filed: Dec. 19, 2011

(65) Prior Publication Data

US 2012/0093667 A1 Apr. 19, 2012

Related U.S. Application Data

(63) Continuation of application No. 12/333,289, filed on Dec. 11, 2008, now Pat. No. 8,113,273.

(51) Int. Cl.

| | |
|---|---|
| ***H01B 7/17*** | (2006.01) |
| ***H01B 7/29*** | (2006.01) |
| ***F04B 47/06*** | (2006.01) |
| ***H01B 3/30*** | (2006.01) |
| ***H01B 3/44*** | (2006.01) |
| *H01B 7/04* | (2006.01) |

(52) U.S. Cl.

CPC ..... *H01B 7/292* (2013.01); *F04B 47/06* (2013.01); *H01B 3/306* (2013.01); *H01B 3/445* (2013.01); *H01B 7/046* (2013.01)

(58) Field of Classification Search

CPC ..... H01B 7/08; H01B 7/0892; H01B 7/17
USPC ..... 166/66.4, 105; 174/117 F, 102 A, 102 C, 174/103; 417/423.3
See application file for complete search history.

(56) References Cited

U.S. PATENT DOCUMENTS

| | | | | | |
|---|---|---|---|---|---|
| 3,404,217 | A | * | 10/1968 | Kelly | 174/103 |
| 3,422,214 | A | * | 1/1969 | Kelly | 174/103 |
| 3,594,492 | A | * | 7/1971 | Bahder et al. | 174/36 |
| 3,745,230 | A | * | 7/1973 | Kelly | 174/103 |
| 3,775,552 | A | * | 11/1973 | Schumacher | 174/105 R |
| 4,096,346 | A | * | 6/1978 | Stine et al. | 174/36 |
| 4,284,841 | A | | 8/1981 | Tijunelis et al. | |
| 4,356,345 | A | * | 10/1982 | Gonia | 174/117 F |
| 4,538,200 | A | * | 8/1985 | Shaikh | 361/117 |
| 4,600,805 | A | * | 7/1986 | Glynn et al. | 174/102 R |
| 4,665,281 | A | | 5/1987 | Kamis | |
| 4,749,823 | A | * | 6/1988 | Ziemek et al. | 174/103 |
| 5,086,196 | A | * | 2/1992 | Brookbank et al. | 174/106 R |
| 5,426,264 | A | | 6/1995 | Livingston et al. | |
| 5,782,301 | A | | 7/1998 | Neuroth et al. | |

(Continued)

FOREIGN PATENT DOCUMENTS

| | | |
|---|---|---|
| GB | 2361352 | 10/2001 |
| GB | 2397700 | 7/2004 |

*Primary Examiner* — Kenneth L Thompson
(74) *Attorney, Agent, or Firm* — Michael Stonebrook

(57) ABSTRACT

An electrical power cable for high temperature environments comprises two or more sheathed conductors; each sheathed conductor comprising an electrical conductor, an electrical insulator surrounding the electrical conductor, and a sheath surrounding the electrical insulator; and a bonding material interconnecting the sheaths of the two or more sheathed conductors positioned adjacent to one another to form a cable.

15 Claims, 6 Drawing Sheets

(56) References Cited

U.S. PATENT DOCUMENTS

| | | | | |
|---|---|---|---|---|
| 6,127,632 | A * | 10/2000 | Oswald | H01B 7/28 174/113 R |
| 6,260,615 | B1 | 7/2001 | Dalrymple et al. | |
| 6,541,706 | B2 * | 4/2003 | McLeod | H01B 7/385 174/102 R |
| 6,910,870 | B2 | 6/2005 | Ebner | |
| 7,049,506 | B2 * | 5/2006 | Head | 174/36 |
| 7,520,768 | B2 | 4/2009 | Nicholson | |
| 8,013,249 | B2 * | 9/2011 | Watanabe et al. | 174/75 C |
| 8,113,273 | B2 * | 2/2012 | Manke | F04B 47/06 166/66.4 |
| 2002/0020545 | A1 | 2/2002 | Suzuki | |
| 2006/0102341 | A1 * | 5/2006 | Freer et al. | 166/250.01 |
| 2006/0266064 | A1 | 11/2006 | Rowatt | |
| 2008/0227341 | A1 | 9/2008 | Nicholson | |

* cited by examiner

POWER CABLE FOR HIGH TEMPERATURE ENVIRONMENTS

RELATED APPLICATION

This application claims priority to and is a continuation of application Ser. No. 12/333,289, filed on Dec. 11, 2008.

BACKGROUND

This section provides background information to facilitate a better understanding of the various aspects of the invention. It should be understood that the statements in this section of this document are to be read in this light, and not as admissions of prior art.

Power cables are utilized in various applications to transmit power, such as electricity, between distal locations. For example, power cables are utilized to transmit electrical power to electric submersible pumps (ESPs). ESPs and power cables that are deployed in wellbores, for example, may encounter high temperatures which degrade convention power cables resulting in the premature failure of the power cables.

SUMMARY

According to one or more embodiments, an electric power cable for high temperature environments includes an electric conductor; an electrical insulator disposed on the electric conductor to form an insulated conductor, the electrical insulator suited for operation in a high temperature environment; and a protective sheath disposed over the insulated conductor to form a sheathed conductor.

According to one or more aspects of the invention, an electrical power cable for high temperature environments comprises two or more sheathed conductors; each sheathed conductor comprising an electrical conductor, an electrical insulator surrounding the electrical conductor, and a sheath surrounding the electrical insulator; and a bonding material interconnecting the sheaths of the two or more sheathed conductors positioned adjacent to one another to form a cable. The cable may be formed in a planar or non-planar shape. In some embodiments the cable does not include an outer layer interconnecting the two or more sheathed conductors.

An illustrative embodiment of a wellbore installation according to one or more aspects of the invention includes an electric submersible pump (ESP) deployed in the wellbore; and a power cable extending between the ESP and a distal electric power source, the power cable comprising: two or more sheathed conductors, each sheathed conductor comprising an electrical conductor, an electrical insulator surrounding the electrical conductor, and a sheath surrounding the electrical insulator; and a bonding material interconnecting the sheaths of the two or more sheathed conductors positioned adjacent to one another to form a cable.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
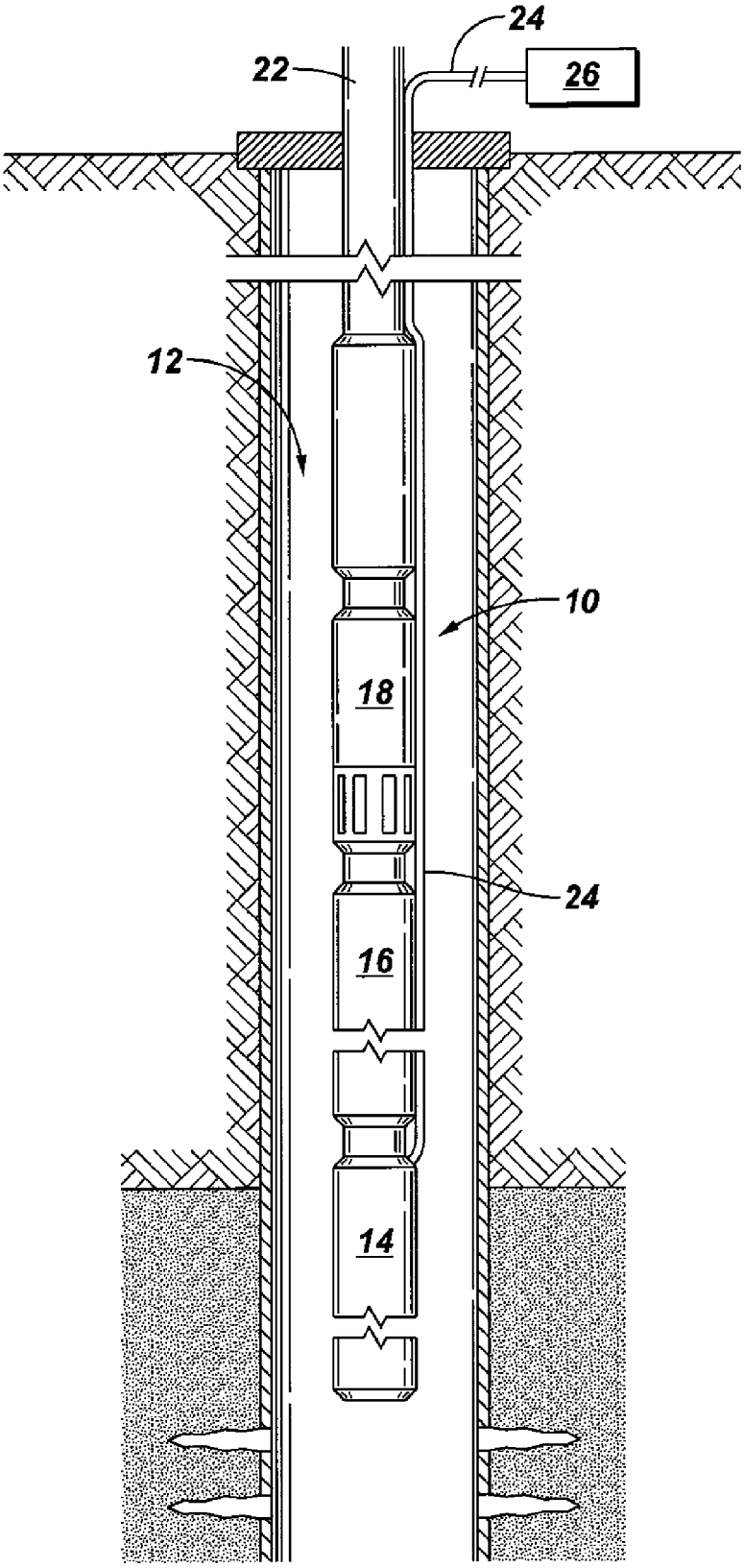
FIG. 1 is a well schematic illustrating and electric submersible pump and power cord according to one or more aspects of the invention deployed in a wellbore.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a well schematic illustrating an electric submersible pump, generally denoted by the numeral 10, deployed in a wellbore 12. In the embodiment illustrated in FIG. 1, ESP 10 includes an electric motor 14, a motor protector 16 and a pump 18. Pump 18 is fluidly connected to the surface 20 via a production conduit 22. A power cable 24 is connected between an electrical power source 26 and pump 18.

Figure 2:
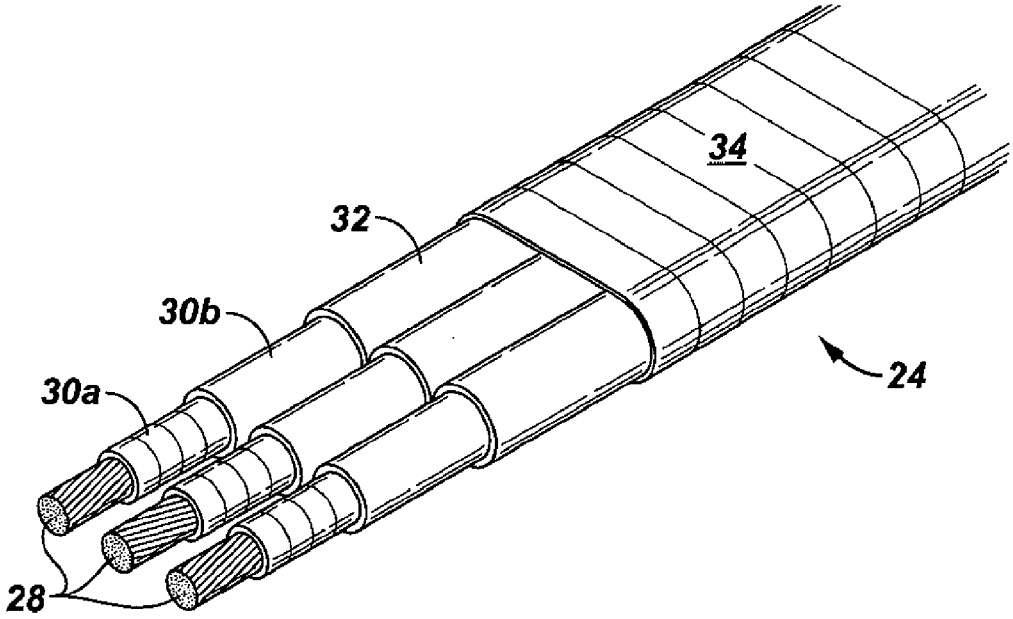
FIG. 2 is an illustration of an embodiment of a power cable according to one or more aspects of the invention.
Figure 3:
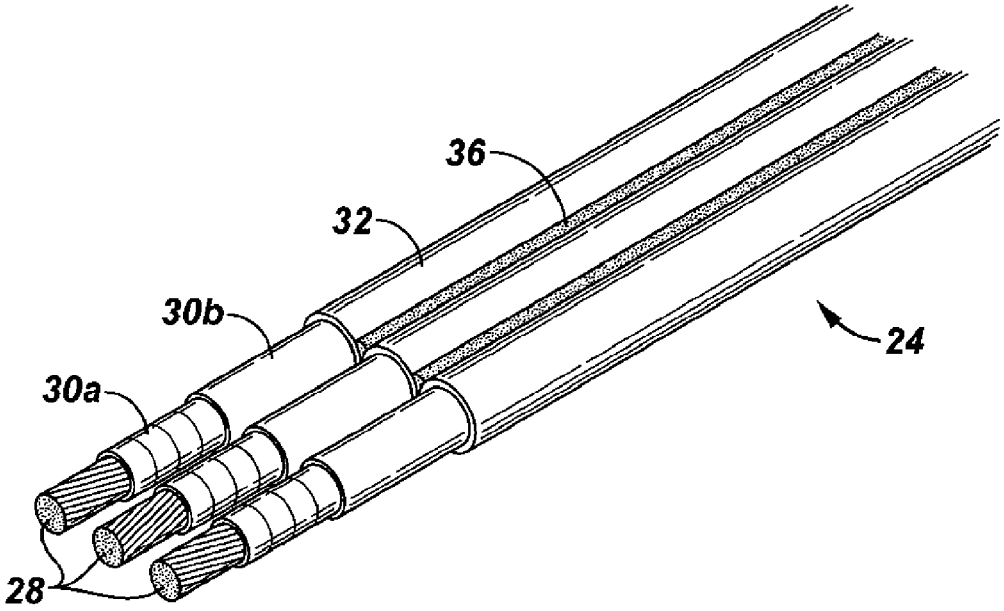
FIG. 3 is an illustration of another embodiment of a power cable according to one or more aspects of the invention.
Figure 4:
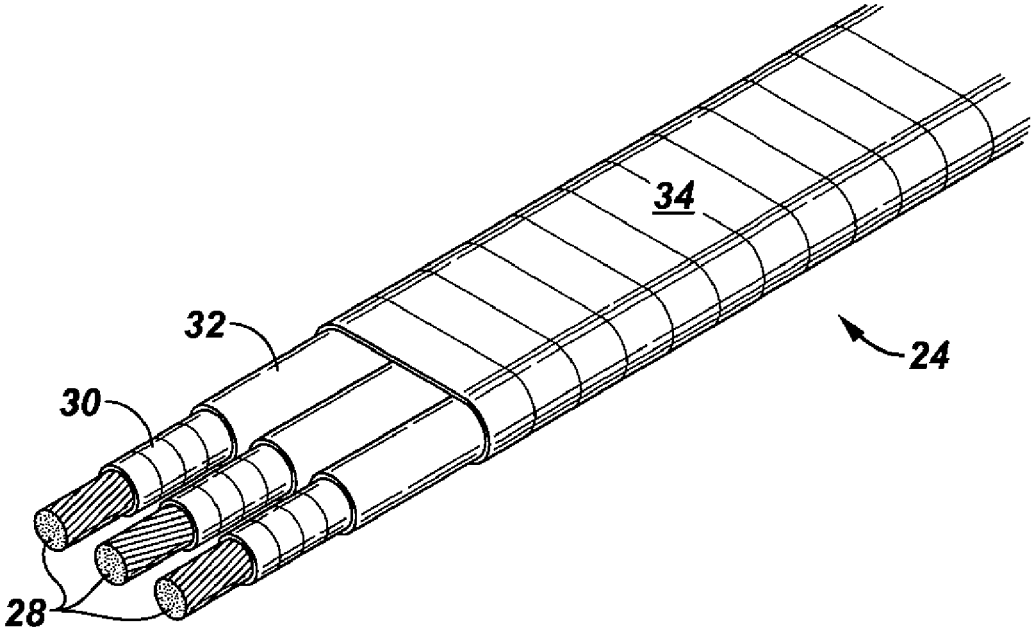
FIG. 4 is an illustration of another embodiment of a power cable according to one or more aspects of the invention.

Refer now to FIG. 2-4 wherein embodiments of power cable 24 that are adapted for use in high temperature environments are illustrated. It is perceived that power cable 24 is suited for installation in environments wherein the temperature is continuously in the range of about 500 degrees Fahrenheit (260 degrees Celsius). It is perceived that power cable 24 can withstand temperatures in excess of 500 degrees F. for extended lengths of times without significant degradation as needed for installations such as a wellbore deployed ESP.

Power cable 24 may include one or more electrical conductors. In the illustrated embodiments, power cable 24 includes three electrical conductors 28. Each conductor 28 is surrounded with an electrical insulation 30 and a protective sheath 32. The two or more of the insulated and sheath conductors are then interconnected to form cable bundle.

Refer now to FIG. 2 wherein an embodiment of power cable 24 is illustrated. Power cable 24 is illustrated as having three electrical conductors 28 formed of copper. In this embodiment, insulator 30 includes at least two layers (30*a*, 30*b*) of insulating material. The insulating layers may be formed of the same or different material. In one example, one insulating layer may be a high temperature dielectric tape and the other layer may be dielectric tape or extruded material.

In the embodiment of FIG. 2, the two layers are formed of different material each of which is suited for continuous exposure of temperature of 500 degrees F. and greater. In this example, first insulating layer 30*a* is a dielectric material such as and without limitation polyimide. Polyimide layer 30*a* is a tape helically wrapped about conductor 28. Second insulating layer 30*b* may be a dielectric material such as without limitation a fluoropolymer tape or an extruded fluoropolymer layer. In one embodiment the fluoropolymer is selected from a group including polytetrafluoroethylene or polytetrafluoroethene (PTFE), fluorinated ethylene propylene (FEP), or perfluoroalkoxy (PFA). If more than one layer of tape is utilized, the layer may be helically wrapped in the same direction or in opposite directions. The material may include an adhesive on one or both sides for bonding to the conductor, itself, other layers of insulating material and the like.

Protective sheath 32 is disposed over the insulated conductor 28. Sheath 32 is constructed of a material suited for protecting the insulated conductor 28 in the environment in which it is deployed. For example, sheath 32 in the illustrated embodiments is constructed of a material that can provide physical protection to conductor 28 in a wellbore environment and in a high temperature environment. In some embodiments, sheath 32 is constructed of a metallic material such as without limitation stainless steel, MONEL, carbon steel, lead or the like.

The insulated and sheathed conductors 28 are interconnected to form a power cable 24 suited for the particular service. In the embodiment of FIG. 2, insulated and sheathed conductors 28 are interconnected by wrapping with an outer layer of material 34. Outer layer 34, referred to from time to time as armor layer 34, may be constructed of a metallic or non-metallic material. In FIG. 2, conductors 28 are shown positioned and interconnected to form a planar power cable 24. However, it should readily be recognized that conductors 28 may be positioned relative to each other in a variety of manners. For example, interconnected conductors 28 may form a triangular or cylindrically shaped power cable 24.

Refer now to FIG. 3, wherein another embodiment of a power cable 24 is illustrated. This embodiment is substantially similar in construction as that described with reference to FIG. 2. One difference between this described embodiment and the prior described embodiment is that the insulated and sheathed conductors 28 are bonded together and do not include an outer layer interconnecting conductors 28. For example, and without limitation, insulated and sheathed conductors 28 may be interconnected by welding or an adhesive material illustrated generally by the numeral 36. For example, in this embodiment sheaths 32 are metallic and sheaths 32 are interconnected by bonding at bead 36.

Referring now to FIG. 4, another embodiment of power cable 24 is illustrated. In this embodiment it is clearly shown that each conductor 28 is insulated with a single layer of insulating material 30. Sheath 32 is then disposed over insulating layer 30 and conductor 28 as further described with reference to FIGS. 2 and 3. Sheathed conductors 28 may then be interconnected to form power cable 24.

Figure 5:
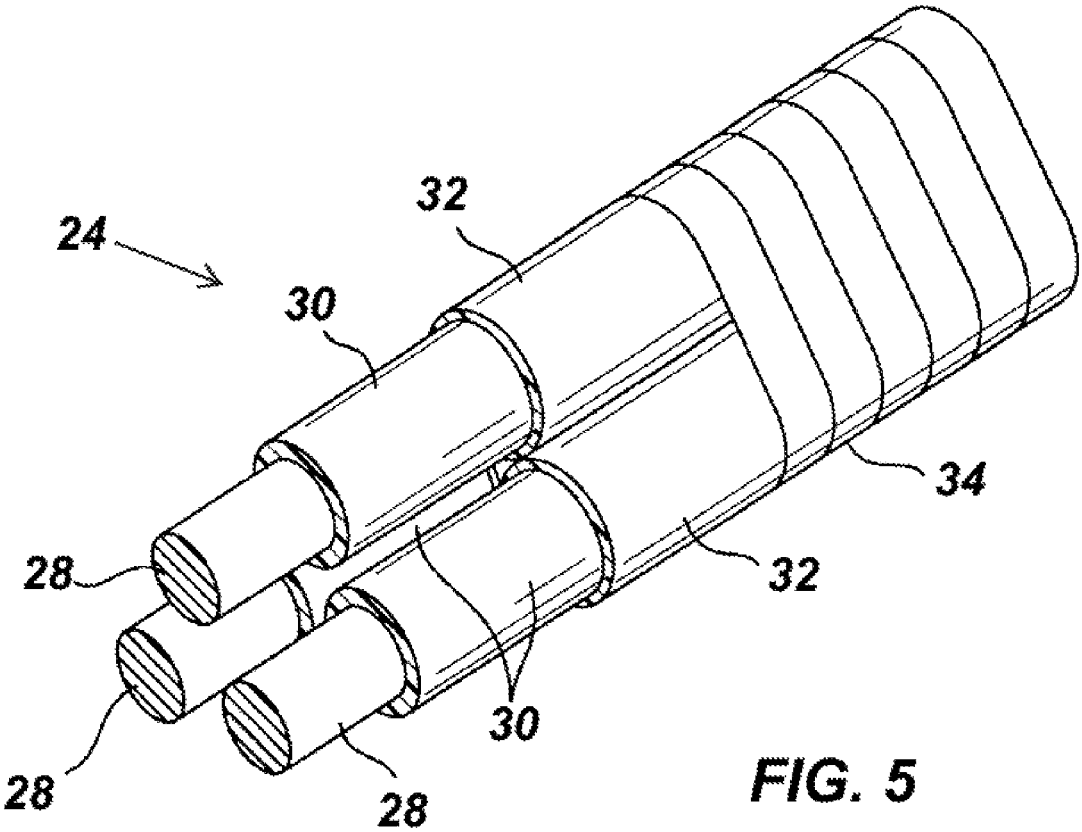
FIG. 5 is an illustration of a non-planar embodiment of a power cable according to the disclosure.

Referring now to FIG. 5, a non-planar embodiment of power cable 24 is illustrated. Specifically, this embodiment presents a triangular shaped power cable 24 wherein the conductors 28 are each insulated with a layer of insulating material 30. However, it should be recognized that more than one layer of insulating material may be used, e.g., as shown in FIGS. 2 and 3. A sheath 32 is disposed over the insulating layer 30 and conductor 28. The sheathed conductors may be interconnected and covered by outer layer 34 to form power cable 24.

Figure 6:
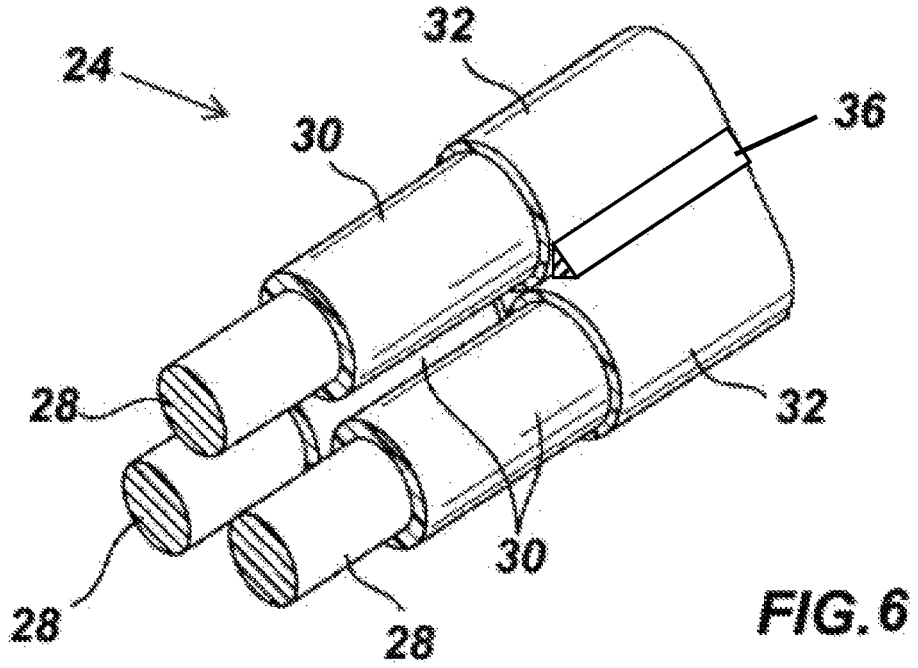
FIG. 6 is an illustration of a non-planar embodiment of a power cable according to the disclosure.

Referring now to FIG. 6, a non-planar embodiment of power cable 24 is illustrated. Specifically, this embodiment presents a triangular shaped power cable 24 wherein the conductors 28 are each insulated with a layer of insulating material 30. However, it should be recognized that more than one layer of insulating material may be used, e.g., as shown in FIGS. 2 and 3. A sheath 32 is disposed over the insulating layer 30 and conductor 28. The sheathed conductors may be interconnected and covered by bead of welding or adhesive material 36 to form power cable 24.

Figure 7:
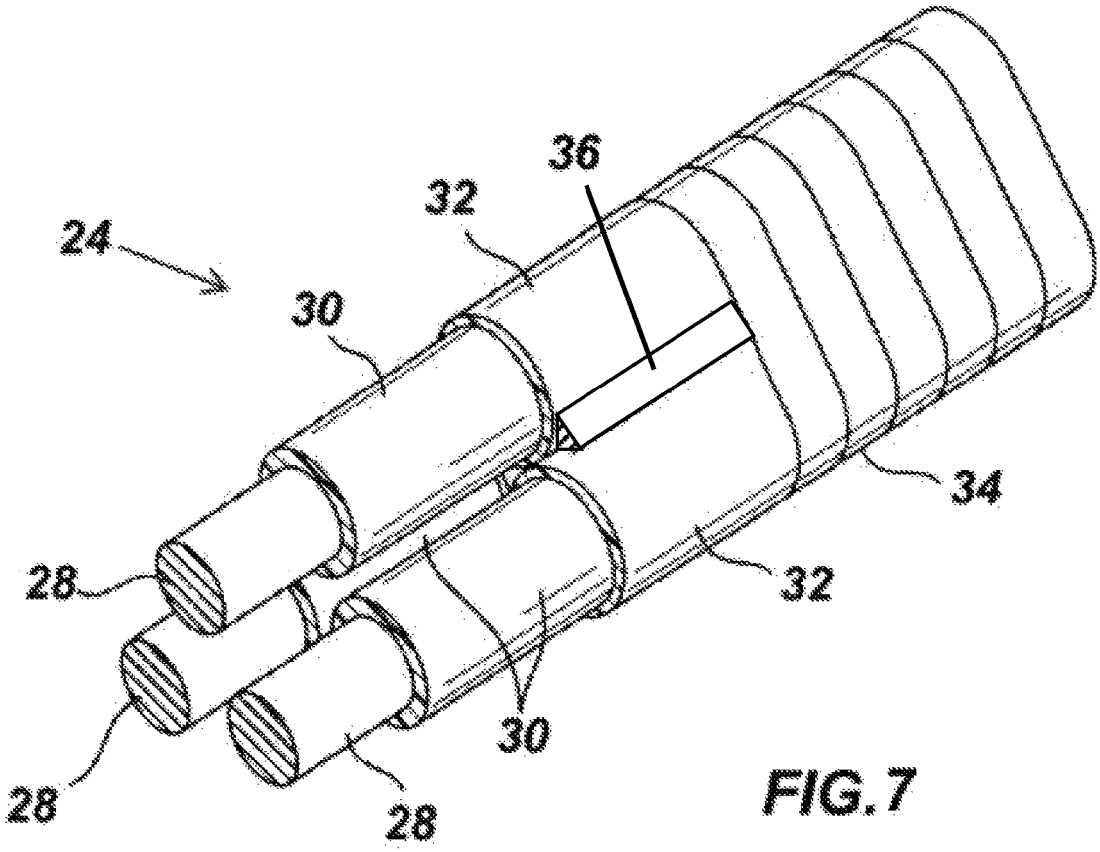
FIG. 7 is an illustration of a non-planar embodiment of a power cable according to the disclosure.

Referring now to FIG. 7, a non-planar embodiment of power cable 24 is illustrated. Specifically, this embodiment presents a triangular shaped power cable 24 wherein the conductors 28 are each insulated with a layer of insulating material 30. However, it should be recognized that more than one layer of insulating material may be used, e.g., as shown in FIGS. 2 and 3. A sheath 32 is disposed over the insulating layer 30 and conductor 28. The sheathed conductors may be interconnected and covered by bead of welding or adhesive material 36 and by outer layer 34 to form power cable 24.

From the foregoing detailed description of specific embodiments of the invention, it should be apparent that a system for a high temperature power cable that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An electrical power cable for high temperature environments, the power cable comprising:

three sheathed conductors, each sheathed conductor comprising an electrical conductor, an electrical insulator surrounding the electrical conductor, and a sheath surrounding the electrical insulator, wherein the sheathed conductors are arranged in a non-planar configuration such that each sheathed conductor contacts at least one other sheathed conductor; and a plurality of beads formed by welding or adhesive material, the plurality of beads being located for interconnecting the sheaths of the three sheathed conductors to form a non-planar shaped cable without an outer armor layer.

2. The power cable of claim 1, wherein the electrical insulator is constructed of a material that provides electric insulation when deployed in a temperature of at least 500 degrees Fahrenheit.

3. The power cable of claim 1, wherein the electrical insulator comprises at least two layers of dielectric material.

4. The power cable of claim 1, wherein the at least two layers of dielectric material are formed of different dielectric materials.

5. The power cable of claim 1, wherein the electrical insulator is formed of a fluoropolymer selected from the group consisting of polytetrafluoroethylene, polytetrafluoroethene, fluorinated ethylene propylene, and perfluoroalkoxy.

6. The power cable of claim 1, wherein the electrical insulator comprises an insulator layer formed of a polyimide material and an insulator layer formed of a fluoropolymer material.

7. A wellbore installation comprising:

an electric submersible pump (ESP) deployed in the wellbore; and a power cable extending between the ESP and a distal electric power source, the power cable comprising:

three sheathed conductors, each sheathed conductor comprising an electrical conductor, an electrical insulator surrounding the electrical conductor, and a sheath surrounding the electrical insulator, wherein the sheathed conductors are arranged in a non-planar configuration such that each sheathed conductor contacts at least one other sheathed conductor; and a plurality of beads formed by welding or adhesive material, the plurality of beads being located for interconnecting the sheaths of the three sheathed conductors to form a non-planar shaped cable.

8. The wellbore installation of claim 7, wherein the electrical insulator is constructed of a material that provides electric insulation when deployed in a temperature of at least 500 degrees Fahrenheit.

9. The wellbore installation of claim 7, wherein the electrical insulator comprises at least two layers of dielectric material.

10. The wellbore installation of claim 7, wherein the at least two layers of dielectric material are formed of different dielectric materials.

11. The wellbore installation of claim 7, wherein the electrical insulator is formed of one of a polyimide or a fluoropolymer.

12. An electric submersible pump (ESP) system, the system comprising:

a pump;

an electric motor connected to the pump; and an electrical power cable connected between the motor and a distal electric power source, the power cable comprising:

a plurality of sheathed conductors, each sheathed conductor comprising an electrical conductor, an electrical insulator surrounding the electrical conductor, and a sheath surrounding the electrical insulator, wherein the sheathed conductors are arranged in a non-planar configuration such that each sheathed conductor contacts at least one other sheathed conductor; and a plurality of beads formed by welding or adhesive material, the plurality of beads being located for interconnecting the sheaths of the sheathed conductors to form a non-planar shaped cable without an outer armor layer.

13. The electric submersible pump (ESP) system of claim 12, wherein the electrical insulator is formed of a fluoropolymer selected from the group consisting of polytetrafluoroethylene, polytetrafluoroethene, fluorinated ethylene propylene, and perfluoroalkoxy.

14. The electric submersible pump (ESP) system of claim 12, wherein the electrical insulator comprises an insulator layer formed of a polyimide material and an insulator layer formed of a fluoropolymer.

15. The electric submersible pump (ESP) system of claim 12, wherein the electrical insulator is constructed of a material that provides electric insulation when deployed in a temperature of at least 500 degrees Fahrenheit.

* * * * *